United States Patent [19]

Soudan, Jr.

[11] Patent Number: 5,050,516

[45] Date of Patent: Sep. 24, 1991

[54] WINDSURFER HAND HARNESS

[75] Inventor: Robert A. Soudan, Jr., 517 Benjamin St., Ann Arbor, Mich. 48104

[73] Assignee: Robert A. Soudan, Jr., Chicago, Ill.

[21] Appl. No.: 531,580

[22] Filed: Aug. 1, 1990

[51] Int. Cl.[5] ..... B63B 35/00

[52] U.S. Cl. ..... 114/39.2; 294/25

[58] Field of Search ..... 114/39.1, 39.2, 89, 114/90; 182/112, 133, 136; 272/68; 294/25, 26, 149, 152, 153

[56] References Cited

U.S. PATENT DOCUMENTS 4,745,870 5/1988 Roth ..... 114/39.2

4,759,306 7/1988 McKenzie ..... 114/39.2

FOREIGN PATENT DOCUMENTS 2646923 4/1978 Fed. Rep. of Germany ..... 1.4/39.2

*Primary Examiner*—Sherman Basinger

*Assistant Examiner*—Stephen P. Avila

*Attorney, Agent, or Firm*—Leydig, Voit & Mayer

[57] ABSTRACT

The hand harness is a device which shall be used to aid the hands in remaining closed around the boom of a sailboard or a land sailboard. This device works, by first very firmly attaching to the forearm a thick sleeve 12 that covers nearly the entire forearm. The inside of this part is to be made of ⅛ inch thick neoprene that is rubberized on the inside (or other comparable material). Across the top of the forearm is a thick nylon strap 7. In the middle of this thick strap is a loop into which the steel finger 3 is attached. The steel finger 3 starts as a rectanglar piece **8*d* that starts in the thick loop in the nylon strap on the middle of the top of the forearm. Finger 3 extends down the forearm and across the hand. From here it goes between (in a closed hand position) the first and second fingers (first being the index) and stops just past the point of contact on a firmly grasped boom 1. A chain, strap, or similar device 16 runs from an extension at the bend in the steel finger 3 and runs to spot 15 that is located at the extreme end of the webbing 14 that sits between the first two fingers. Its purpose is to clamp down the steel finger 3 when the hand is closed about boom 1.**

9 Claims, 5 Drawing Sheets

WINDSURFER HAND HARNESS

BACKGROUND OF THE INVENTION

When sailing a device with a non-stationary rig attached by a universal joint to the deck, it is required that the sailor hold the rig in position. This includes sailboards, which are basically surfboards anywhere from eight to twelve feet long with a rig attached; and land sailboards, which look like elongated skateboards and are used on smooth land. The nature of sailboards requires that they be sailed most frequently on a reach. To accomplish a reach the sailor must position the rig so as that his back is facing the wind. Holding the rig in an upright position by the boom requires the sailor to pull towards himself as well as towards the stern of the board so as to create forward momentum. The force applied by the sailor often needs to be quite strong and must be continuous. Providing this force is done primarily be leaning backward and using the mass of the body to counteract the the force of the wind. The actual grasping of the boom by the hands must therefore bear the brunt of the fatigue. Fingers must stay tight around the boom for extended periods of time which can, on particularly windy days, cause muscle fatigue in the muscles in the forearm.

At this point in time the current method of alleviating the fatigue is done by use of a chest, waist, or seat harness. Here a hook is attached to a body harness. A line is attached to the boom so as that if forms a semi-loop centered over the center of pull necessary to keep the rig in proper position. The sailor then bends to engage the hook in the line and then leans with the majority of his weight on the harness system leaving a little of the weight to his hands so as to allow him to steer and adjust. This system is widely used and is fairly successful but has its disadvantages. The harness must be disengaged when jibing, tacking, and most importantly: falling. If under control the harness is easy to disengage where then the sailor uses only his hands to guide the rig during say a jibe. When hit by a gust, lull, lift, or knock when the system is engaged, however, disengaging becomes more difficult. It often results in the sailor being thrown dangerously into the sail and/or the boom. The sailor can also become trapped under water by the sail and is still attached to the boom by the harness line that has twisted around the hook. Body harnesses can be even more dangerous when used with a land sailboard; dangerous to the point where they are rarely used.

SUMMARY OF INVENTION

The applicant's invention encompasses a novel harness system which alleviates forearm muscle fatigue, as well as the risk of failed disengagement. The invention is a type of harness system that attaches to the arm and hand of the sailor. This is advantageous because, unlike the body harness, the body is not restricted to a fixed distance from the boom. The invention also has advantages over other harness systems such as U.S. Pat. No. 4,759,306 in that it allows control with the hands rather than with straps. The invention has on it a steel finger 3 which falls between the first two fingers and provides the grip necessary to hold on while still allowing for hand control. Unlike the sailor's actual fingers, the steel finger 3 does not open and close. Rather, it pivots up and down, moved by both webbing 14 between the fingers and chain 16 that is attached to the webbing at the end of the fingers at one end and to grommet 10 near the bend in the steel finger 3 at the other. When the hand closes around boom 1 the chain 16 pulls the finger into a force supporting position on the boom. The force is distributed throughout a sleeve that is tightened around the entire forearm. Chain 16 then "locks" finger 3 into position about the boom, for the fingers wrap about two-thirds of the way around the boom thus providing easily controllable force against any tendency of the steel finger 20 to slip up off of boom 1. This is much like the way in which a ski boot clamp uses the force it is holding to lock it in place.

The device is also innovative in its ease of disengagement. The angle 18 of the bend in the finger, is just enough to let the "finger" want to disengage if there is pulling force upon it, yet not so much as that the small force of the fingers (real) and chain clamping action cannot easily hold the steel finger 20 in place. As a result, when the sailor opens his hands to let go of boom 1, the steel finger 20 will naturally slide off the boom and will be helped by webbing 14 between the sailor's fingers. As a result, this system allows a doubly foolproof disengagement system, an advantage not seen in any existing device.

A BRIEF DESCRIPTION OF THE DRAWINGS

DESCRIPTION OF THE PREFERRED EMBODIMENTS

Figure 1:
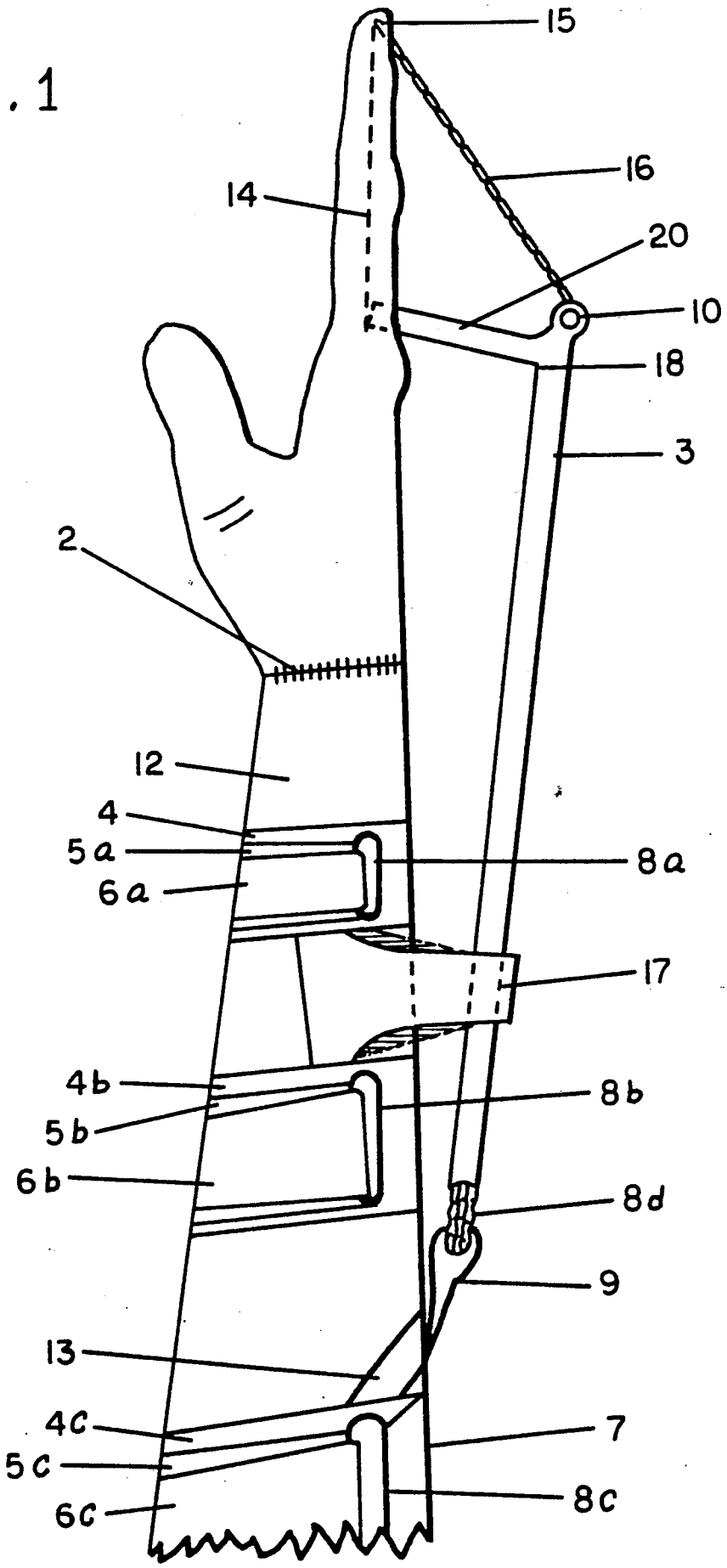
FIG. 1 is a side view of a right handed apparatus of the invention in the open position.

Referring to the drawings, sleeve 12 is comprised of rubberized neoprene or similar material an stretches from just past the elbow of the sailor all the way into glove 2 that covers the first two fingers and possibly all of them. By utilizing a rubberized neoprene with the rubber side down, the entire apparatus will have less tendency to slip down the forearm when engaged. Alternatively, from the wrist forward different materials can be used such as light canvas and/or nylon in order to give the sailor a better feel for the boom.

Figure 5:
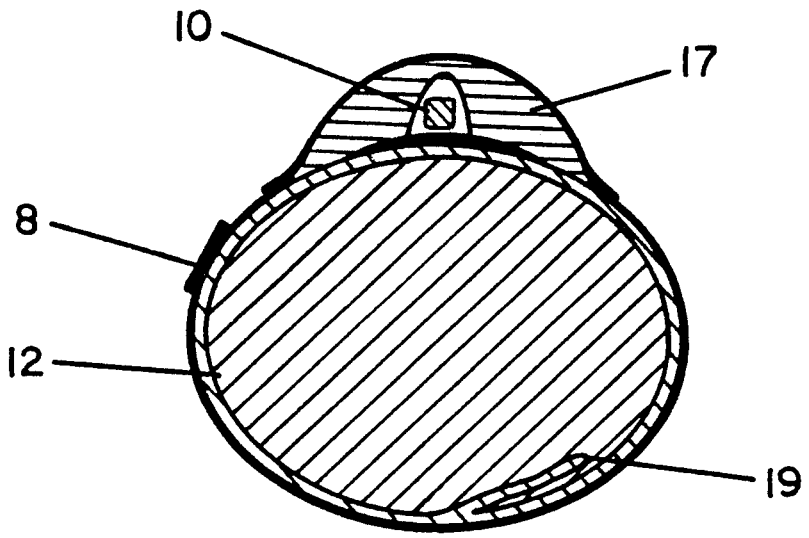
FIG. 5 is a cross sectional view of FIG. 3 taken along line 5–3 from the rear.

The device will be attached by nylon strapping 4*a*, 4*b*, and 4*c* which is to be stitched onto sleeve 12. Straps 6*a*, 6*b*, and 6*c* tighten around buckles 8*a*, 8*b*, and 8*c*, respectively and then are secured upon 5*a*, 5*b*, and 5*c*, which are continuations of straps 6*a*, 6*b*, and 6*c*, by a fastener, such as a hook and pile means, sold under the registered trademark VELCRO. As FIG. 5 indicates, a cut in sleeve 12 is bound by a slackened material 19 such as cotton or nylon to allow for proper fit as well as donning and removal ease. Buckles 8*a*, 8*b*, and 8*c* may be located on either the inside or outside of the arm according to comfort and ease of tightening leverage.

Figure 3:
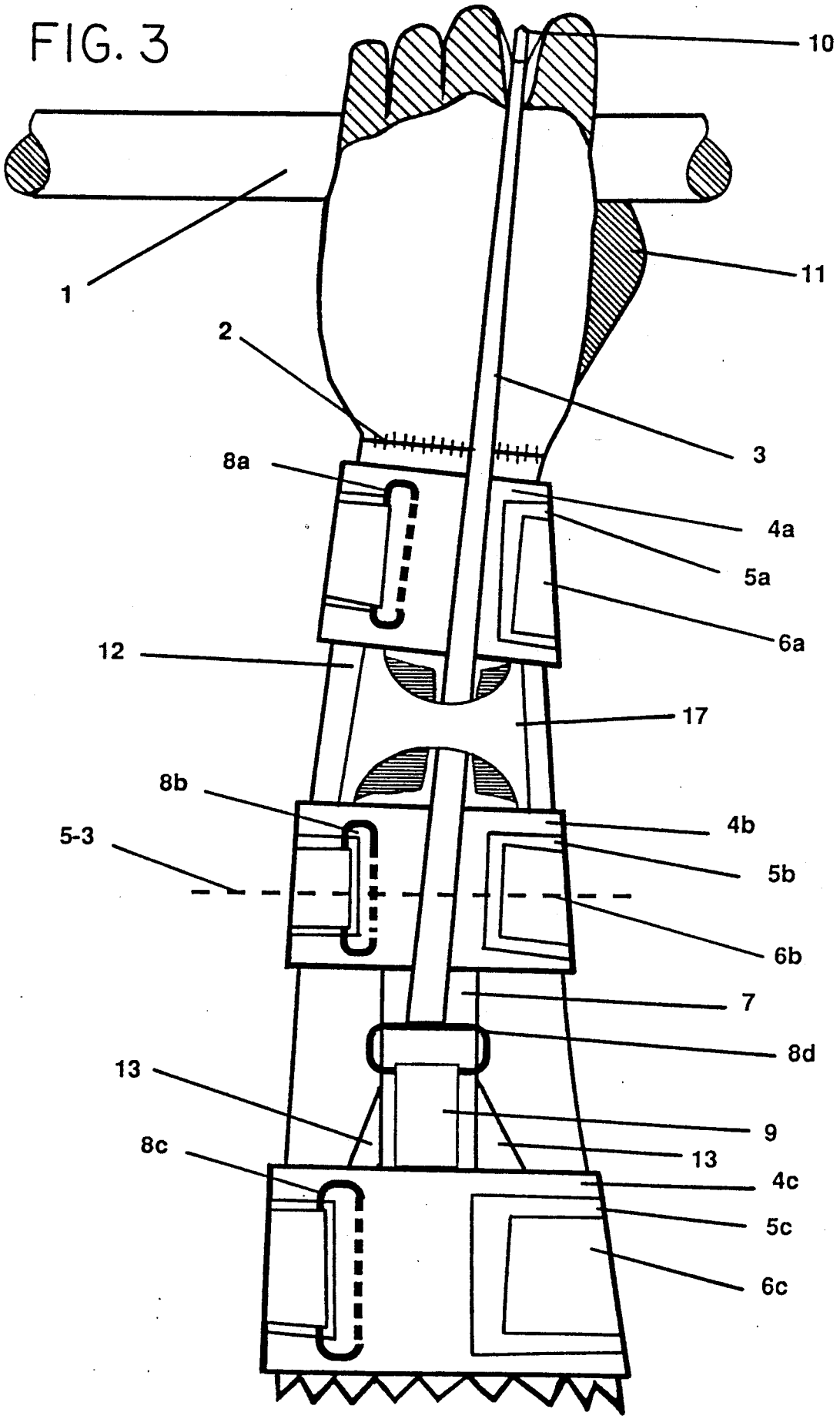
FIG. 3 is a plan view of a left handed apparatus of the invention in the closed position.
Figure 4:
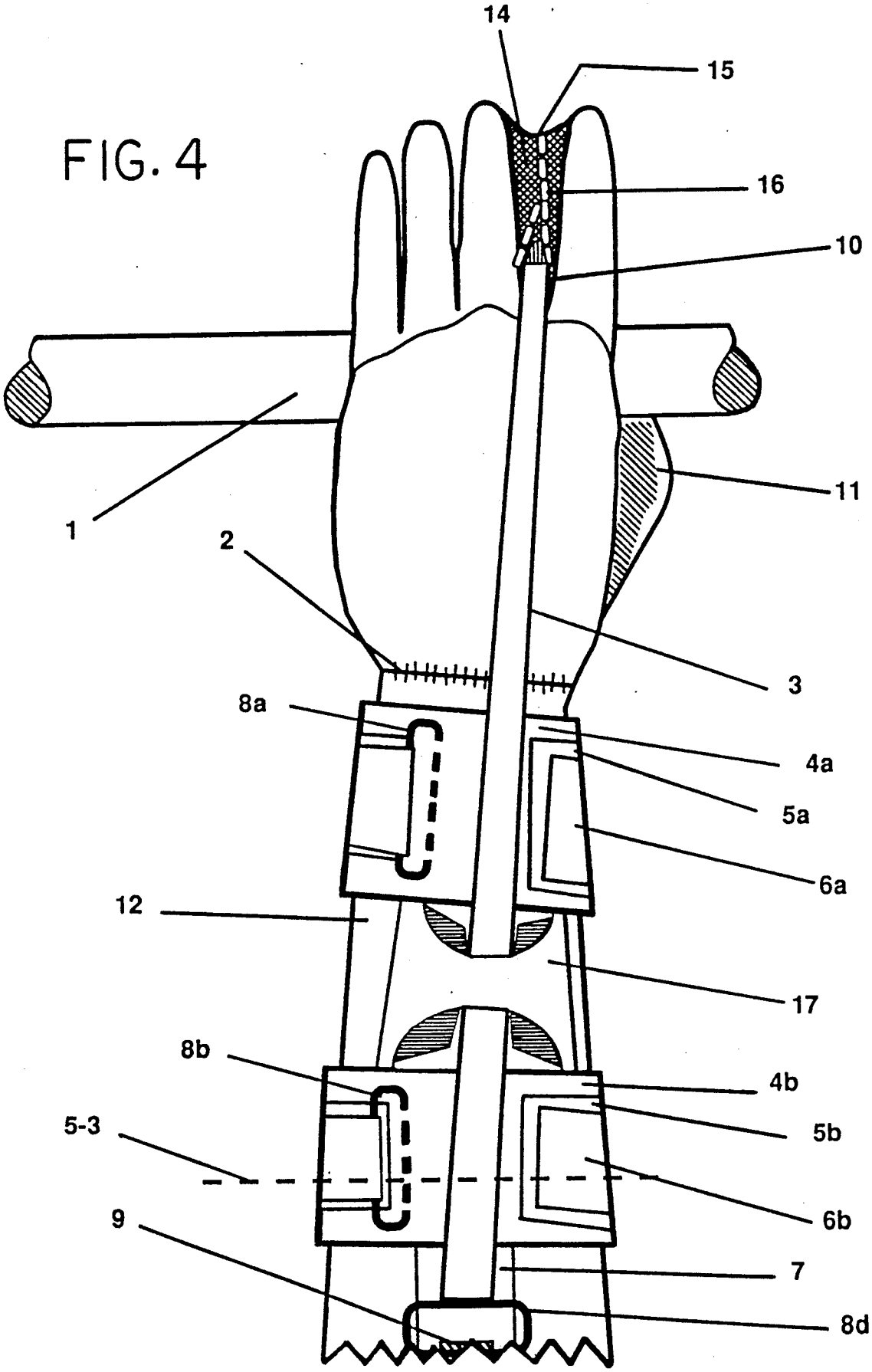
FIG. 4 is an overhead view of the apparatus of FIG. 3 in the open position.

A nylon strap 9, as seen in FIG. 4 is to be the primary attachment of the steel finger 3 to the apparatus an therefore receives the bulk of the pulling force. As FIG. 3 indicates, strap 9 must be significantly wide enough to stop finger 3 from any roll motion, although guide 17 also performs this task. Although not shown, strap 9 may be adjustable so as to allow the distance of finger extension 20 to be correct for the amount of force the sailor wants to be carried on boom 1 by the invention versus by his own strength. This will differ from sailor to sailor, for each will decide what is his best feel/comfort ratio. Nylon strap 7 (viewed best in FIG. 3) is what strap 9 is anchored upon and its function is to help distribute the force of pull over more of the forearm the prevent excess skin pull in a specific area. Straps 13 also preform this duty although they distribute the force to the sides and underside of the arm.

Buckle **8*d* is what connects finger 3 to strap 9 and thus the whole system. Buckle 8*d* and strap 9 must both be positioned so as that finger extension 20 will naturally fall into position between the index and second finger of the sailor. A guiding device 17 will also help in aligning finger 3 into the correct position. Guide 17 should be made of a flexible yet resilient material such as waterproof foam rubber or similar material. Across the top and possibly internalized within guide 17 is a nylon strap that provides strength to 17 that may be needed if finger 3 is raised abnormally high. Guide 17 also functions to stop finger 3 from going into a position that may injure one of the sailor's fingers. Guide 17** may also be adjustable with nylon straps and VELCRO® on both sides of the arm (not shown). This is probably not necessary, but will help to assure a proper fit.

Figure 2:
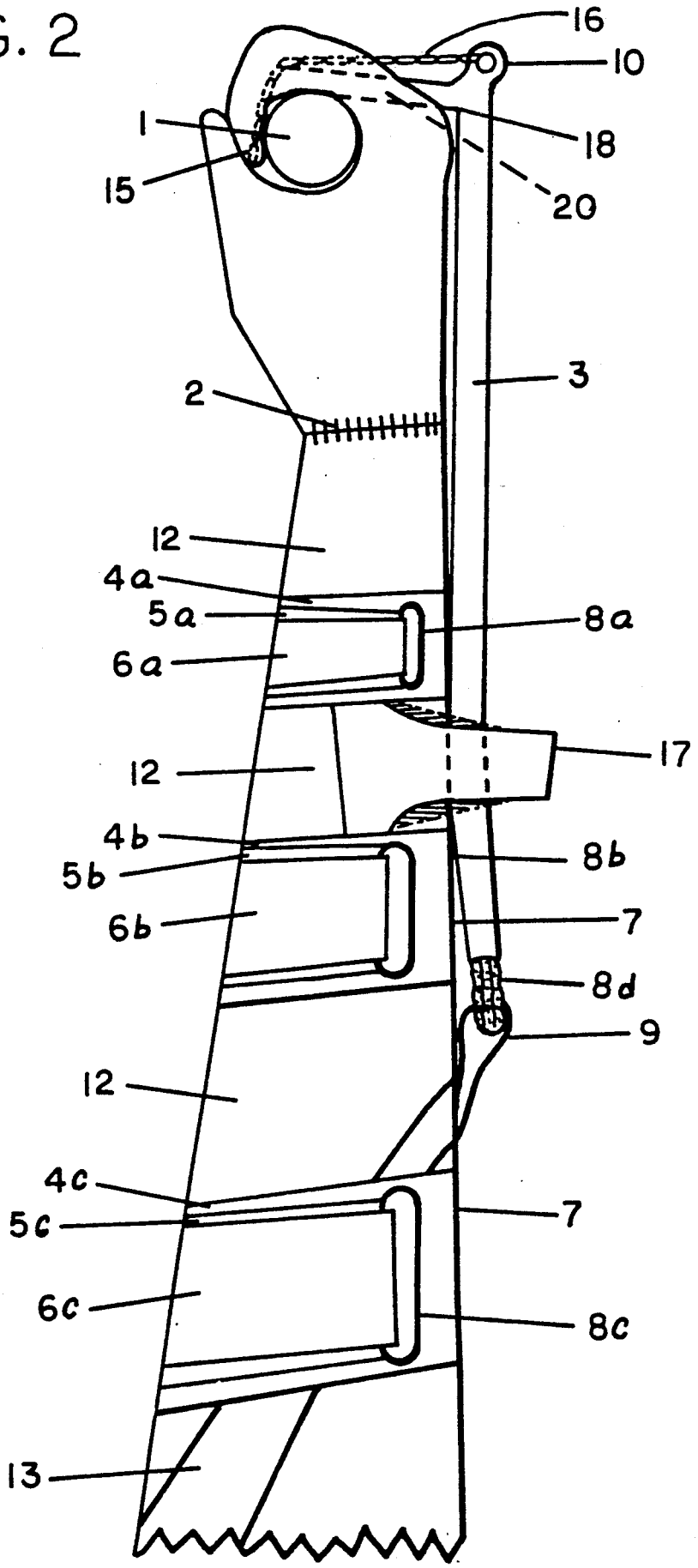
FIG. 2 is a side view of the apparatus of FIG. 1 in the closed position.

Probably the most important feature of the invention is angle 18, which is seen in FIG. 1 and FIG. 2 between finger 3 and finger extension 20. Angle 18 must be at an angle such that finger extension 20 is able to hold boom 1 securely when hand is in the closed position (FIG. 2). Yet it must also be at an angle such that if there is no downward pressure exerted on grommet 10 by chain 16 from attachment spot 15, then the apparatus 3 and 20 would have a weak but definite tendency to lift away from boom 1. Finger extension 20 will not be sliding directly on boom 1, rather it will always slide on interdigital webbing 14 (see FIG. 4). Webbing 14 will be made of a durable material such as canvas or nylon. It is to be coated with a slippery material such as plastic, mylar, and the like. This will allow for a consistent functioning of finger extension 20 no matter what the surface of boom 1 may be like. Webbing 14's other roll is to aid in the lifting of finger extension 20 when the hand opens. Although it should lift on its own when chain 16 is slackened by the opening of the hand, webbing 14 will make sure it lifts all the way free of 1 when the sailor lets go either on purpose or to fall.

The end of finger extension 20 should be rounded so as that it will not catch on webbing 14 or the materials covering the first two fingers.

Device 16 is to be made of a flexible material such as a chain, thin strap, or rope. It is crucial that chain 16 be a length such as that it will be tight in the closed position (FIG. 2) so as that it will prevent finger extension 20 from lifting and thus detaching from boom 1. When in the open position, chain 16 must be long enough to allow the sailor's hand to extend fully, yet not so long as that it would tangle in any apparatus. There will be an optimal length determined by the placement of grommet 10. The further forward (towards the north edge in FIG. 2) that grommet 10 is, the more chain 16 will slacken in the open position. Note that the angle 18 must stay in its position of just past the sailor's knuckles. Again, this distance can be adjusted by an adjuster on strap 9. If sailors of different size have trouble with a fixed mounted grommet 10, then an adjustable grommet 10 could easily be implemented as a sliding track on the top of finger 3 (not shown).

Pads (not shown) may be used on the hands to block the top of the hand from excess pressure by finger 3 when in the closed position.

If wind becomes sufficiently light, the sailor may not need the aid of the invention in which case a variation of the invention will allow for permanent disengagement. In such a case chain 16 would be disconnected at point 15 and reattached at a point on finger 3 where it can be stored out of the way. In addition, a small strap would be attached to guide 17 that would hold finger 3 at it highest point, out of the way of the sailor's hands. This is not a necessary part of the invention, but it allows for added versatility and utility to the sailor.

The addition of battens (not shown) to sleeve 12 may be helpful to increase support and the distribution of force to the lower forearm and wrist area.

Above is the basic spirit of the invention. Modifications will most likely become apparent to those skilled in the art. These modifications should be within the spirit of the invention and therefore should not limited thereby.

I claim:

1. An arm mounted harness for use with a sailboard having a boom, the harness comprising:

a hollow sleeve mountable about the forearm of the user;

strap means mounted on the sleeve for releasably securing the sleeve on the forearm fo the user;

a rigid finger having a first linear portion and a second end portion bent at an angle with respect to the first linear portion, said finger being disposed adjacent a back side of a user's forearm secured in said sleeve, means for pivotally mounting one end of the first linear portion of the finger on the sleeve, webbing means attached to one end of the sleeve extending in web-like fashion between two fingers of a user, and connector means connected at one end to the webbing means and, at another end, to an intermediate portion of the finger between the first and second ends of the figure for pivoting the second end portion of the finger between a first position spaced from the fingers of a user and a second position in which the second end portion of the finger extends between the fingers of a user and engages the boom of a sailboard when the user's fingers are wrapped around the boom of the sailboard.

2. The harness of claim 1 further including:

guide means, mounted on the sleeve, for guiding the pivotal movement of the finger.

3. The harness of claim 1 wherein the sleeve is formed of neoprene from the wrist backward and a glove portion formed of nylon secured to said sleeve and including said webbing means.

4. The harness of claim 1 wherein the pivotally mounting means comprises:

an adjustable strap mounted on the sleeve for adjusting the position of the finger on the sleeve.

5. The harness of claim 3 further including means, mounted on the sleeve for releasably and selectively holding the second end portion of the finger spaced from the webbing means for permanent disengaement.

6. The harness of claim 1 further including:

means for adjustably connecting the connector means to an intermediate portion of the first linear portion of the finger for permanent disengagement.

7. The harness of claim 1 further including:

a pad mounted on the top of the hand to block excess pressure on the top of the hand by first portion of finger.

8. The harness of claim 1 further including:

an adjustably positional connecting spot for connector means at the intermediate portion of the finger between the first and second ends of the finger.

9. The harness of claim 1 further including:

battens attached to the sleeve under securing devices to increase distribution of force.

* * * * *